US010868390B2

(12) United States Patent
Costello

(10) Patent No.: US 10,868,390 B2
(45) Date of Patent: Dec. 15, 2020

(54) CONNECTOR ASSEMBLY HAVING COUPLED MODULES

(71) Applicant: TE CONNECTIVITY CORPORATION, Berwyn, PA (US)

(72) Inventor: Brian Patrick Costello, Scotts Valley, CA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 384 days.

(21) Appl. No.: 15/898,795

(22) Filed: Feb. 19, 2018

(65) Prior Publication Data

US 2019/0260160 A1 Aug. 22, 2019

(51) Int. Cl.

| | |
|---|---|
| ***H01R 13/621*** | (2006.01) |
| ***H01R 9/24*** | (2006.01) |
| ***H01R 13/514*** | (2006.01) |
| ***H01R 13/518*** | (2006.01) |
| ***H01R 13/516*** | (2006.01) |

(52) U.S. Cl.

CPC ..... *H01R 13/6215* (2013.01); *H01R 9/2408* (2013.01); *H01R 9/2491* (2013.01); *H01R 13/514* (2013.01); *H01R 13/516* (2013.01); *H01R 13/518* (2013.01)

(58) Field of Classification Search

CPC ..... H01R 13/6215; H01R 9/2491; H01R 9/2408; H01R 13/518; H01R 13/635; H01R 25/003; H01R 13/514; H01R 13/516

USPC ..... 439/359, 361, 368, 107, 712

See application file for complete search history.

(56) References Cited

U.S. PATENT DOCUMENTS

| | | | | |
|---|---|---|---|---|
| 5,431,573 A * | 7/1995 | Endo | H01R 13/518 | 439/157 |
| 7,074,080 B1 * | 7/2006 | Khemakhem | H01R 13/518 | 439/578 |
| 2012/0122335 A1 * | 5/2012 | Costello | H04Q 1/035 | 439/502 |

* cited by examiner

*Primary Examiner* — Nguyen Tran
*Assistant Examiner* — Paul D Baillargeon

(57) ABSTRACT

A connector assembly includes a first module and a second module. Each of the first and second modules extends parallel to a longitudinal axis between a respective front end and a respective rear end opposite the front end. Each of the first and second modules includes a respective shell and one or more electrical connectors held by the shell and exposed at the respective front end for mating to a corresponding mating electrical device. The shell of the second module is mechanically coupled to the shell of the first module between the front and rear ends of the first module. The second module is movable relative to the first module parallel to the longitudinal axis to allow for separately mating the first and second modules to the corresponding mating electrical devices.

20 Claims, 7 Drawing Sheets

CONNECTOR ASSEMBLY HAVING COUPLED MODULES

BACKGROUND OF THE INVENTION

The subject matter herein relates generally to assemblies of electrical connectors for electrically connecting electrical devices, such as servers or network switches.

Some electrical systems require electrically connecting two or more electrical devices that are disposed adjacent to each other. For example, network switches and/or servers may be stacked vertically adjacent to each other on different shelves or racks of a chassis. It may be desirable to electrically connect a first server on one shelf to an adjacent, second server on the shelf directly below, to enable the first and second servers to communicate with each other.

Some known electrical systems utilize cable harnesses to electrically connect adjacent electrical devices (e.g., servers, network switches, or the like). The cable harnesses include one or more electrical cables fixed to, and extending between, two electrical connectors that each connect to a different one of the electrical devices. But, the length of the cable may be much longer than the distance between the adjacent electrical devices, resulting in excess slack cable. The excess slack cable may add complexity and interfere with other components within a space-restricted environment of the electrical system. In addition, the excess slack cable may abut against walls of the chassis, applying undesirable forces on the mated connectors that could damage the connectors or interfere with signal transmission through the connectors.

Other known electrical systems utilize unitary, monolithic block-like structures to electrically connect adjacent electrical devices. The monolithic block structures hold all of the connectors used to connect to both of the electrical devices on a single, rigid substrate, such that a first connector that connects to a first of the electrical devices is secured in a fixed position relative to a second connector that connects to a second of the electrical devices. An example of such a monolithic block structure is multiple connectors mounted on a single printed circuit board, such that the circuit board is the single, rigid substrate. Since the connectors are fixed in position relative to each other on the substrate, the monolithic block structure may not be able to sufficiently accommodate misalignment of the electrical devices caused by aggregated tolerances within the system and/or bowed components. For example, if a first connector on the first electrical device projects outward in a depth or "Z" direction farther than a second connector on the adjacent, second electrical device, then the monolithic block structure may bottom out upon reaching the fully mated position with the first connector, while the monolithic block structure is only able to partially mate to the second connector. Another issue with fixed monolithic block structures is high insertion forces needed to mate the connectors to the electrical devices due to all of the connectors mating at the same time. Due to the aggregated insertion forces, it may be difficult for an operator to connect the monolithic block structure to the electrical devices by hand.

A need remains for a connector assembly for electrically connecting adjacent electrical devices that is compact, does not apply undue stress on the connectors, accommodates some misalignment, and does not require undue manual effort for mating and un-mating.

BRIEF DESCRIPTION OF THE INVENTION

In one or more embodiments of the present disclosure, a connector assembly is provided that includes a first module and a second module. Each of the first and second modules extends parallel to a longitudinal axis between a respective front end and a respective rear end opposite the front end. Each of the first and second modules includes a respective shell and one or more electrical connectors held by the shell and exposed at the respective front end for mating to a corresponding mating electrical device. The shell of the second module is mechanically coupled to the shell of the first module between the front and rear ends of the first module. The shell of the second module is movable relative to the first module parallel to the longitudinal axis to allow for separately mating the first and second modules to the corresponding mating electrical devices.

In one or more embodiments of the present disclosure, a connector assembly is provided that includes a first module, a second module, and a wire bundle of multiple electrical wires. The first module includes a shell and one or more electrical connectors held by the shell and exposed at a front end of the first module for mating to a first electrical device. The second module includes a shell and one or more electrical connectors held by the shell of the second module and exposed at a front end of the second module for mating to a second electrical device. The wire bundle has a first end electrically connected to the one or more electrical connectors of the first module within the shell of the first module, and a second end electrically connected to the one or more electrical connectors of the second module within the shell of the second module. The first and second modules are stacked adjacent to each other and are mechanically coupled to each other such that a module gap is defined between an inner wall of the shell of the first module and an inner wall of the shell of the second module. The wire bundle extends through respective openings in the inner walls of the first and second modules and across the module gap.

In one or more embodiments of the present disclosure, a connector assembly is provided that includes an upper module and a lower module. The upper module includes a shell having a front wall and a rear wall opposite the front wall. The upper module includes multiple electrical connectors arranged side by side parallel to a lateral axis. Each of the electrical connectors includes a housing held by the shell and signal contacts within the housing that are exposed along the front wall of the shell. The lower module includes a shell having a front wall and a rear wall opposite the front wall. The lower module includes multiple electrical connectors arranged side by side parallel to the lateral axis. Each of the electrical connectors of the lower module including a housing held by the shell of the lower module and signal contacts within the housing that are exposed along the front wall of the shell of the lower module. The upper module is stacked vertically above the lower module. The shell of the upper module is mechanically coupled to the shell of the lower module and movable relative to the shell of the lower module parallel to a longitudinal axis that is perpendicular to the lateral axis to allow for separately mating the upper and lower modules to corresponding first and second electrical devices.

DETAILED DESCRIPTION OF THE INVENTION

Figure 1:
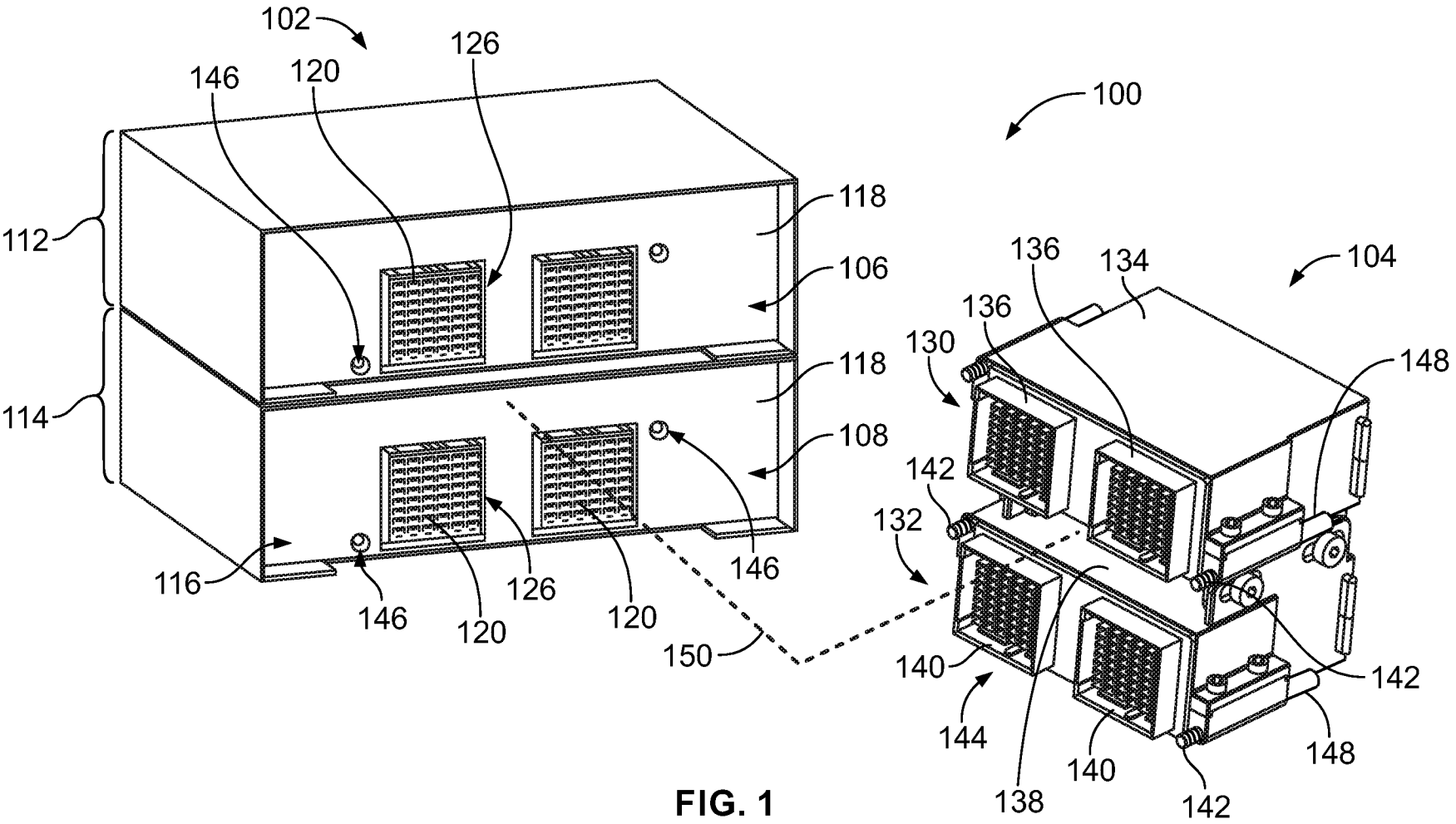
FIG. 1 is a perspective view of an electrical system in accordance with an embodiment.

Embodiments of the present disclosure provide a novel and non-obvious way to establish electrical connections between electrical devices that are disposed adjacent to one another in close proximity. For example, the embodiments disclosed herein provide a connector assembly with a first module and a second module that are mechanically coupled to each other and also movable relative to each other along a longitudinal axis. The first module has one or more connectors that are configured to mate to complementary connectors of a first electrical device in a mating direction that is parallel to the longitudinal axis. The second module has one or more connectors that are configured to mate to complementary connectors of a second electrical device in the mating direction. The first and second electrical devices may be adjacent to each other, such as stacked side by side either vertically or horizontally. Since the first and second modules are movable relative to each other along the longitudinal axis parallel to the mating direction, the first module may be mated to the first electrical device independently of the second module mating to the second electrical device. For example, the first module may be moved relative to the second module in the mating direction to mate the first module to the first electrical device during a first time period, and then the second module may be moved relative to the first module in the mating direction to mate the second module to the second electrical device during a subsequent, second time period.

Since the first and second modules can be mated independently to the corresponding electrical devices, the connector assembly can accommodate misalignment between the first and second electrical devices in the depth or longitudinal axis. For example, if the mating ends of the connectors on the first electrical device are a stepped distance apart from the mating ends of the connectors on the second electrical device, the connector assembly may conform when mating such that the first module attains a mated position that is the stepped distance along the longitudinal axis from the mated position of the second module. Furthermore, independent mating of the first and second modules of the connector assembly allows for separate, sequential mating of the first and second modules, which significantly reduces the insertion forces required at each of the mating steps. For example, instead of mating four connectors in a fixed block to four mating connectors at one time, the connector assembly allows for mating only two of the four connectors at a time, which reduces the required insertion forces by at least half. The connector assembly according to one or more embodiments may be relatively compact without any wires or cables that project outward from the connector assembly in the space-restricted environment of the electrical system, which may beneficially allow space for other components and/or increased air flow through the electrical system.

FIG. 1 is a perspective view of an electrical system 100 in accordance with an embodiment that includes a device assembly 102 and a connector assembly 104. The connector assembly 104 is poised for mating to the device assembly 102. The device assembly 102 includes a first electrical device 106 and a second electrical device 108 that are adjacent to one another. The first and second electrical devices 106, 108 are both mounted to a chassis or rack (not shown). Each of the first and second electrical devices 106, 108 may be a network server, a network switch, or another type of electrical device. For example the first electrical device 106 may be a first server, and the second electrical device 108 may be a second server mounted to the rack directly below the upper shelf 112. FIG. 1 may show a back end 116 of the device assembly 102. The first and second electrical devices 106, 108 each include a rear panel 118 at the back end 116 and multiple electrical connectors 120. Although not shown in FIG. 1 the electrical connectors 120 may be board-mounted to respective circuit boards 122, 124 (shown in FIG. 6) of the electrical devices 106, 108. The electrical connectors 120 of the first and second electrical devices 106, 108 are exposed in respective openings or windows 126 of the rear panels 118. In an alternative embodiment, the electrical connectors 120 may be exposed in openings or windows of a common rear panel of the chassis or rack, instead of through separate rear panels 118 of the devices 106, 108.

The connector assembly 104 is configured to mate to the device assembly 102 to electrically connect the first electrical device 106 to the second electrical device 108. For example, the connector assembly 104 provides a conductive signal pathway that bridges the first and second electrical devices 106, 108 to allow the first electrical device 106 to communicate with the second electrical device 108. The connector assembly 104 mates to the device assembly 102 at the back end 116. When mated, the connector assembly 104 projects rearwardly beyond the rear panels 118 of the electrical devices 106, 108.

In an embodiment, the connector assembly 104 includes a first module 130 and a second module 132 that are mechanically coupled together. The first module 130 includes a shell 134 and one or more electrical connectors 136 that are held by the shell 134. Likewise, the second module 132 includes a shell 138 and one or more electrical connectors 140 held by the shell 138. In the illustrated embodiment, the first module 130 includes two electrical connectors 136, and the second module 132 includes two electrical connectors 140. But, in other embodiments, the first module 130 and/or the second module 132 may include only one or more than two of the respective electrical connectors 136, 140. The electrical connectors 136 of the first module 130 are configured to mate to corresponding electrical connectors 120 of the first electrical device 106, and the electrical connectors 140 of the second module 132 are configured to mate to corresponding electrical connectors 120 of the second electrical device 108. Although not shown in FIG. 1, the electrical connectors 136 of the first module 130 are electrically connected to the electrical connectors 140 of the second module 132 within the connector assembly 104 to establish the conductive signal pathway that bridges the first and second electrical devices 106, 108.

The electrical connectors 136, 140 of the connector assembly 104 are complementary to the electrical connectors 120 of the device assembly 102. In the illustrated embodiment, the electrical connectors 136, 140 are header connectors and the electrical connectors 120 are receptacle connectors. In other embodiments, however, at least some of the electrical connectors 136, 140 may be receptacle connectors, and at least some of the electrical connectors 120 may be header connectors.

The connector assembly 104 has a mating end 144 that is configured to engage and interface with the device assembly 102. The connector assembly 104 is moved along a mating trajectory or pathway 150 to mate with the device assembly 102. The electrical connectors 136, 140 of both the first and second modules 130, 132 are exposed along the mating end 144 for mating to the corresponding electrical connectors 120. Optionally, the shells 134, 138 of the first and second modules 130, 132 may hold lock screws 142 at the mating end 144. During the mating operation, the lock screws 142 are configured to be received within corresponding apertures 146 in the rear panels 118 of the electrical devices 106, 108 to secure the connector assembly 104 to the electrical devices 106, 108. More specifically, the lock screws 142 are configured to secure the first and second modules 130, 132 in the mated positions relative to the corresponding first and second electrical devices 106, 108. Alternatively, the rear panels 118 may be components of the chassis or rack, instead of the electrical devices 106, 108, such that the lock screws 142 secure the modules 130, 132 indirectly to the electrical devices 106, 108 via direct mechanical coupling to the chassis. The lock screws 142 may be manipulated manually by an operator by turning a knob end 148 of the lock screws 142. The connector assembly 104 includes four total lock screws 142 in the illustrated embodiment, but may include more or less than four lock screws 142 in other embodiments. Alternatively, other locking mechanisms may be used, such as spring latches or interference detents.

Figure 2:
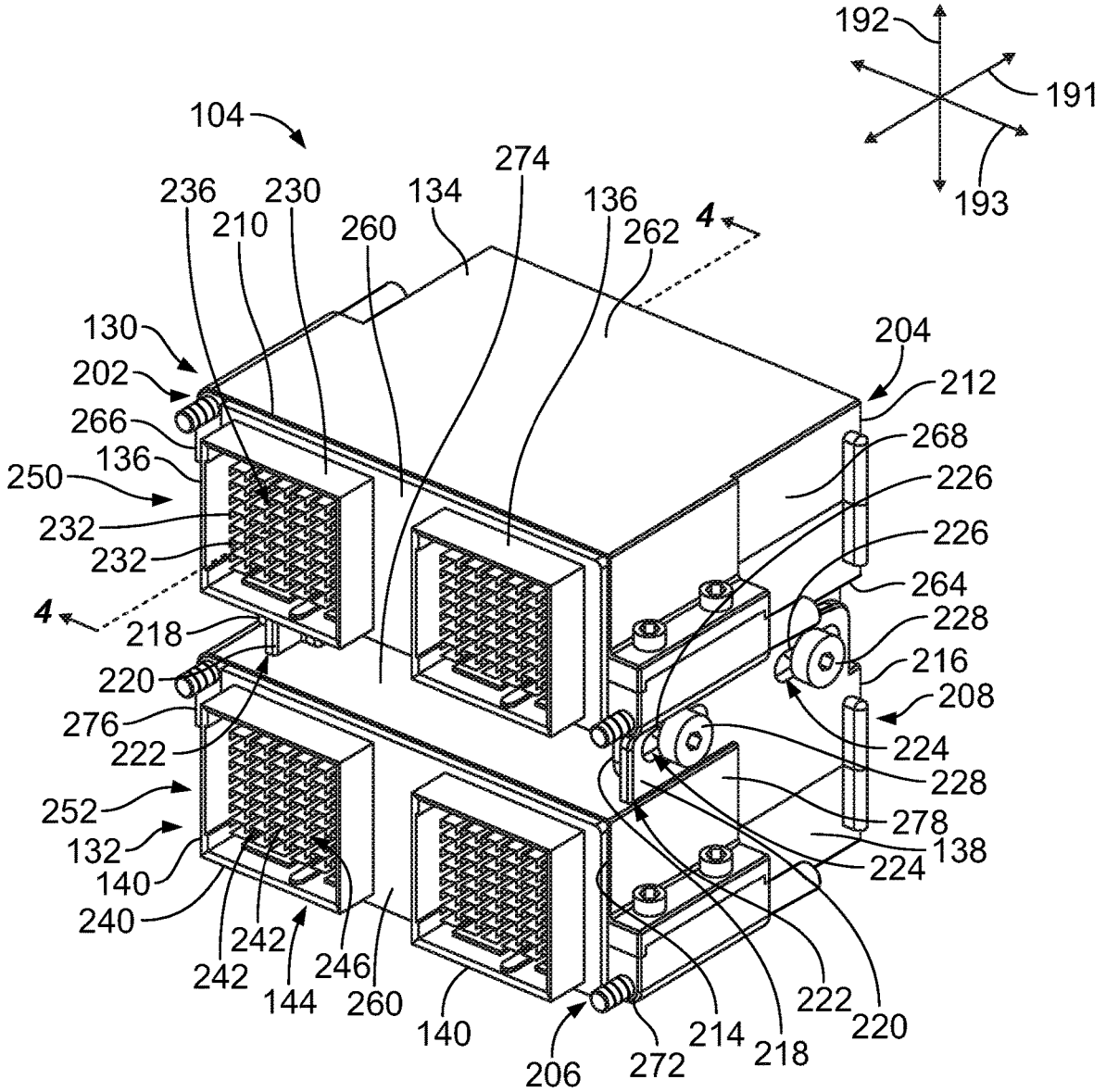
FIG. 2 is a front perspective view of a connector assembly of the electrical system according to an embodiment.

FIG. 2 is a front perspective view of the connector assembly 104 according to an embodiment. The connector assembly 104 is oriented with respect to a longitudinal or depth axis 191, a vertical axis 192, and a lateral axis 193. The axes 191-193 are mutually perpendicular. Although the vertical axis 192 appears to extend in a vertical direction parallel to gravity in FIG. 2, it is understood that the axes 191-193 are not required to have any particular orientation with respect to gravity.

The modules 130, 132 are stacked adjacent to each other and mechanically coupled together. The first module 130 has a front end 202 and a rear end 204 that is opposite the front end 202. Similarly, the second module 132 has a front end 206 and a rear end 208 that is opposite the front end 206. The front ends 202, 206 are spaced apart longitudinally (e.g., along the longitudinal axis 191) from the respective rear ends 204, 208. The first and second modules 130, 132 are oriented relative to each other such that the front ends 202, 206 generally align and the rear ends 204, 208 generally align. The term "generally align" is used because, as described herein, the first and second modules 130, 132 are movable relative to each other within a defined range of motion parallel to the longitudinal axis 191 such that the front ends 202, 206 may be offset from each other in some positions or configurations of the connector assembly 104. The connectors 136, 140 are exposed at the corresponding front ends 202, 206. The mating end 144 of the connector assembly 104 may be defined by the front ends 202, 206 of the modules 130, 132. As used herein, relative or spatial terms such as "top," "bottom," "upper," "lower," "front," and "rear" are only used to distinguish the referenced elements based on the illustrated orientations and do not necessarily require particular positions or orientations in the surrounding environment of the connector assembly 104.

The shell 134 of the first module 130 has a front wall 210 at or proximate to the front end 202 of the first module 130 and a rear wall 212 at or proximate to the rear end 204. Similarly, the shell 138 of the second module 132 has a front wall 214 at or proximate to the front end 206 of the second module 132 and a rear wall 216 at or proximate to the rear end 208. The shells 134, 138 are mechanically coupled together such that the shells 134, 138 overlap between the front ends 202, 206 and the rear ends 204, 208. The shells 134, 138 may be coupled together at one or more coupling locations that are disposed between the front ends 202, 206 and the rear ends 204, 208.

The first and second modules 130, 132 are movable relative to each other parallel to (e.g., along) the longitudinal axis 191. For example, the modules 130, 132 can float relative to each other along a defined path parallel to the longitudinal axis 191, while remaining mechanically coupled together. The longitudinal float of the modules 130, 132 allows for separately mating the two modules 130, 132 to the corresponding electrical devices 106, 108 (shown in FIG. 1). For example, the modules 130, 132 may mate to the corresponding electrical devices 106, 108 in a mating direction 602 (shown in FIGS. 6 and 8) that is parallel to the longitudinal axis 191. Therefore, the longitudinal float allows the first module 130 to be mated to the first electrical device 106 prior to, or after, mating the second module 132 to the second electrical device 108. It is recognized that the modules 130, 132 may also be able to move or float vertically and/or laterally relative to each other, in addition to longitudinally.

The shells 134, 138 of the first and second modules 130, 132 include complementary coupling features that engage to mechanically couple the modules 130, 132 and allow for the longitudinal movement between the modules 130, 132. In one or more embodiments, the shell 134 of the first module 130 has one or more coupling flanges 218 that project from the shell 134 and are coupled to the shell 138 of the second module 132. The shell 138 of the second module 132 includes one or more coupling flanges 220 that project from the shell 138 and are coupled to the shell 134 of the first module 130. In the illustrated embodiment, each of the shells 134, 138 has multiple respective coupling flanges 218, 220. Each of the coupling flanges 218 are connected to a different one of the coupling flanges 220 to define flange pairs 222. In each flange pair 222, one or both of the coupling flanges 218, 220 define one or more slots 224 therethrough. The one or more slots 224 are elongated parallel to the longitudinal axis 191. In an embodiment, one of the two coupling flanges 218, 220 in each flange pair 222 defines one or more slots 224, and the other coupling flange 218, 220 defines a smaller aperture 502, as shown and described with reference to FIG. 5. Each of the slots 224 receives a post 226 therein. The post 226 has a smaller size than the corresponding slot 224, such that the post 226 is able to move longitudinally within the slot 224 between the ends of the slot 224. The permissible range of longitudinal float between the first and second modules 130, 132 may be defined and constrained by the interaction between the posts 226 and the slots 224. In the illustrated embodiment, the posts 226 are shafts of fasteners 228. The fasteners 228 may be bolts, screws, pins, or the like. The fasteners 228 may extend at least partially through both of the coupling flanges 218, 220 in the flange pair 222. In an alternative embodiment, the posts 226 may be integral protrusions on one or both of the coupling flanges 218, 220 in the flange pair 222.

For example, in such alternative embodiment, the coupling flange 218 of the shell 134 may include one or more protrusions that represent the posts 226, and the coupling flange 220 of the shell 138 may define one or more slots 224 that receive the one or more protrusions.

The shell 134 of the first module 130 includes an outer wall 262, an inner wall 264 opposite the outer wall 262, and two side walls 266, 268 that extend from the outer wall 262 to the inner wall 264. All four walls 262, 264, 266, 268 extend from the front wall 210 to the rear wall 212. The shell 138 of the second module 132 includes an outer wall 272, an inner wall 274 opposite the outer wall 272, and two side walls 276, 278 that extend from the outer wall 272 to the inner wall 274. All four walls 272, 274, 276, 278 extend from the front wall 214 to the rear wall 216.

Each of the connectors 136 of the first module 130 has a respective housing 230 and multiple signal contacts 232 held by the housing 230. The housings 230 are mounted to the shell 134. For example, the housings 230 may be secured to the shell 134 via flanges, fasteners, adhesives, or the like. In the illustrated embodiment, the housings 230 project forward beyond the front wall 210 of the shell 134 at the front end 202. The signal contacts 232 may be arranged in rows and columns to define a matrix or array 236. The signal contacts 232 may be configured to transmit differential signals. In a non-limiting example embodiment, each of the connectors 136 includes 48 differential signal pairs of signal contacts 232.

Each of the connectors 140 of the second module 132 has a respective housing 240 and multiple signal contacts 242 held by the housing 240. The housings 240 are mounted to the shell 138. In the illustrated embodiment, the connectors 140 of the second module 132 are mounted to the shell 138 in the same arrangement that the connectors 136 of the first module 130 are mounted to the shell 134. For example, the housings 240 project beyond the front wall 214 of the shell 138 at the front end 206. The connectors 140 of the second module 132 optionally are replicas of the connectors 136 of the first module 130. For example, the signal contacts 242 may be arranged in rows and columns in a matrix 246, and the signal contacts 242 may be configured to transmit differential signals. In an alternative embodiment, the connectors 140 of the second module 132 may be different than the connectors 136 of the first module 130.

In the illustrated embodiment, the first module 130 is stacked vertically above the second module 132 along the vertical axis 192. As used herein, the first module 130 may be referred to as an upper module 130, and the second module 132 may be referred to as a lower module 132 due to the vertical relationship between the modules 130, 132. It is recognized that the "upper" and "lower" designations refers to the illustrated orientation. For example, the upper and lower modules 130, 132 may be laterally adjacent to each other instead of vertically if the connector assembly 104 is rotated 90 degrees about the longitudinal axis 191. The connectors 136 of the upper module 130 are arranged side by side in a row 250, and the connectors 140 of the lower module 132 are arranged side by side in a row 252. The rows 250, 252 may be parallel to each other, and may be parallel to the lateral axis 193. Although each of the modules 130, 132 has two respective connectors 136, 140 in the illustrated embodiment, the modules 130, 132 may have any number of connectors 136, 140.

Optionally, the connector assembly 104 includes an electromagnetic interference (EMI) containment layer 260 that is mounted to the respective front walls 210, 214 of the shells 134, 138. The EMI containment layer 260 includes a conductive material, such as one or more metal sheets, conductive particles embedded within a dielectric base, a conductive polymer, or the like. The EMI containment layer 260 is configured to block EMI transmission or leakage at the interfaces between the modules 130, 132 and the electrical devices 106, 108 (shown in FIG. 1). In the illustrated embodiment, the housings 230, 240 of the connectors 136, 140, respectively, protrude through the EMI containment layer 260 such that the EMI containment layer 260 extends around the perimeter of each of the housings 230, 240. The EMI containment layer 260 may be two discrete pieces, as shown in FIG. 2. For example, a first piece of the EMI containment layer 260 is mounted to the shell 134 of the first module 130, and a second piece is mounted to the shell 138 of the second module 132.

Figure 3:
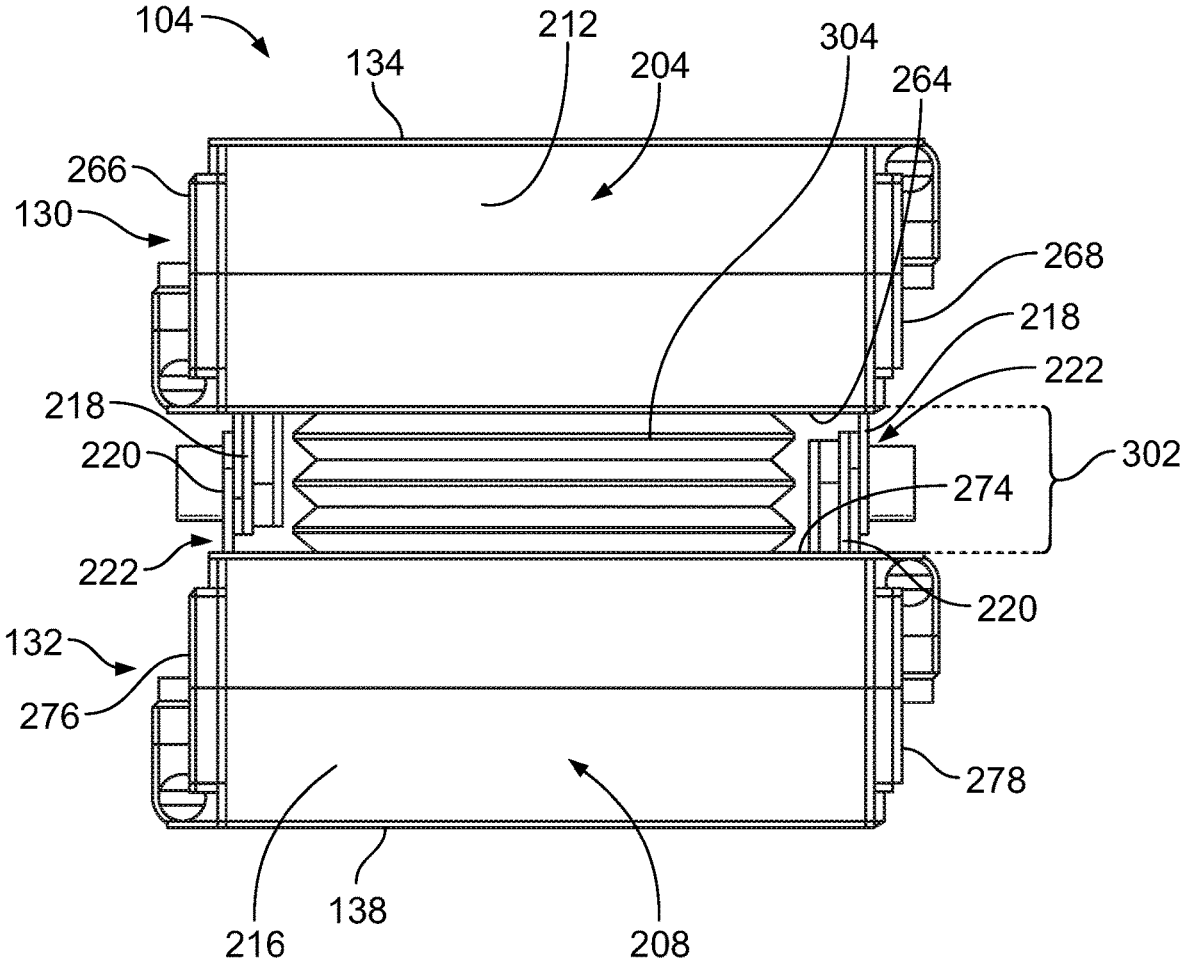
FIG. 3 is a rear view of the connector assembly according to an embodiment.

FIG. 3 is a rear view of the connector assembly 104 according to an embodiment. The rear view shows the rear end 204 of the first module 130 and the rear end 208 of the second module 132. In the illustrated embodiment, the rear wall 212 of the shell 134 of the first module 130 and the rear wall 216 of the shell 138 of the second module 132 are both planar and lack openings. The inner wall 264 of the shell 134 of the first module 130 may be separated from the inner wall 274 of the shell 138 of the second module 132 via a module gap 302. The height of the module gap 302 is defined by the distance between the inner walls 264, 274. The coupling flanges 218, 220 extend into the module gap 302. The coupling flanges 218, 220 may engage and couple to each other within the module gap 302. Optionally, the coupling flanges 218 of the first module 130 extend into the module gap 302 from the inner wall 264, and the coupling flanges 220 of the second module 132 extend into the module gap 302 from the inner wall 274. In the illustrated orientation of the connector assembly 104, the inner wall 264 is a bottom wall of the shell 134, and the inner wall 274 is a top wall of the shell 138. In an alternative embodiment, one or more of the coupling flanges 218, 220 may extend beyond the module gap 302 and couple to the corresponding shell 134, 138 along one or both of the respective side walls 266, 268, 276, 278.

In the illustrated embodiment, the two flange pairs 222 are spaced apart laterally from each other, and a flexible shroud 304 is disposed between the two flange pairs 222. The flexible shroud 304 extends across the module gap 302 from the shell 134 to the shell 138. For example, the flexible shroud 304 may be mounted to both the inner wall 264 of the shell 134 and the inner wall 274 of the shell 138. The flexible shroud 304 optionally has an accordion or bellows-style shape, but may have other shapes in other embodiments. The flexible shroud 304 may be hollow, as shown in FIG. 4.

Figure 4:
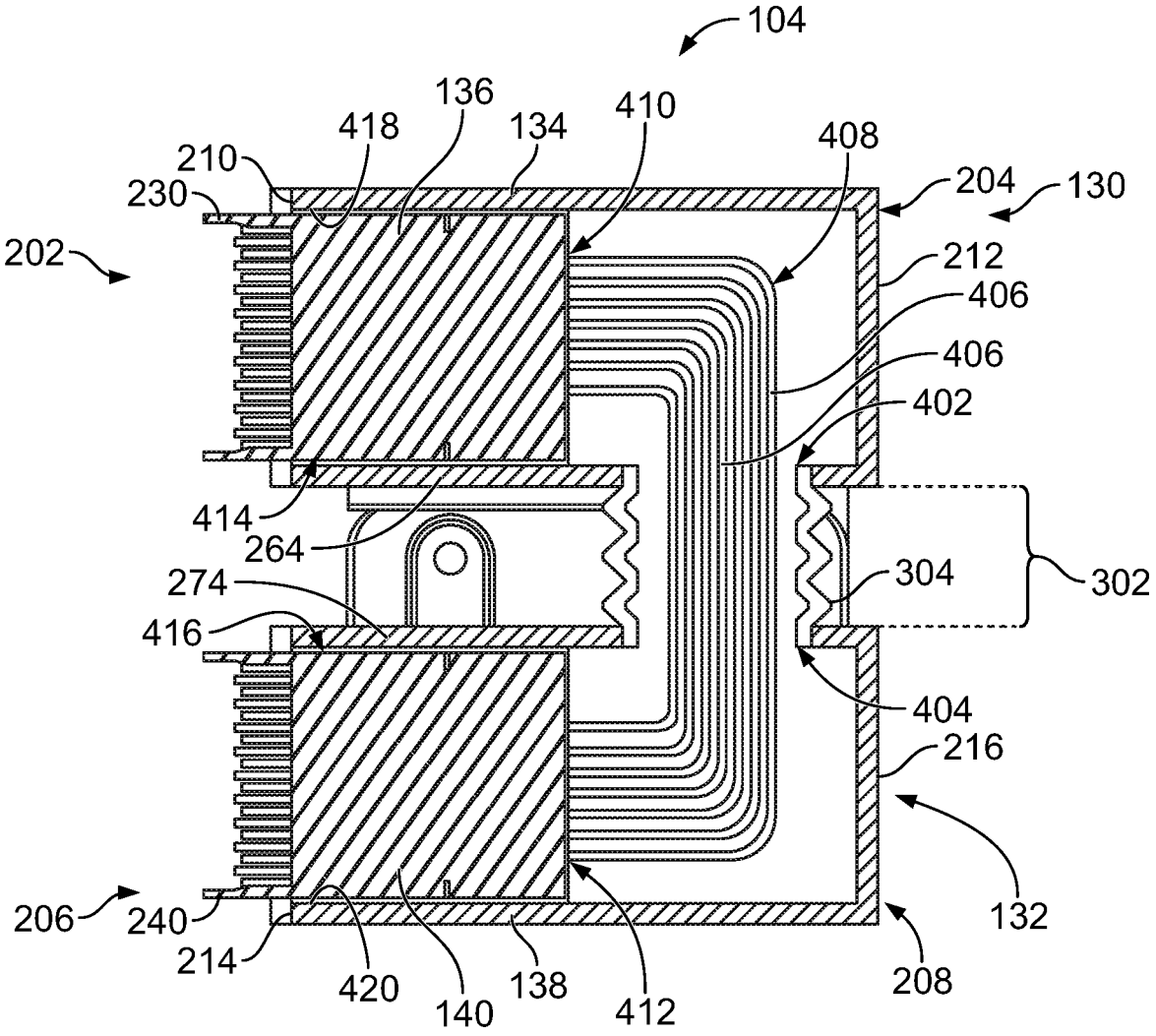
FIG. 4 is a side cross-sectional view of the connector assembly according to an embodiment.

FIG. 4 is a side cross-sectional view of the connector assembly 104 according to an embodiment. The cross-section is taken along line 4-4 in FIG. 2. The shell 134 of the first module 130 defines an opening 402, referred to herein as a wire opening 402, through the inner wall 264. Likewise, the shell 138 of the second module 132 defines an opening 404 (e.g., a wire opening 404) through the inner wall 274. Both of the inner walls 264, 274 may be oriented parallel to the longitudinal axis 191 (FIG. 2).

In the illustrated embodiment, the electrical connectors 136 of the first module 130 are electrically connected to the electrical connectors 140 of the second module 132 via one or more electrical wires 406. For example, the electrical connectors 136, 140 are cable-mounted connectors. The one or more wires 406 in the illustrated embodiment include a plurality of wires 406 defining a wire bundle 408. The wire bundle 408 has a first end 410 within the shell 134 of the first module 130, and a second end 412 opposite the first end 410 that is within the shell 138 of the second module 132. The first end 410 is electrically connected to the electrical connectors 136, and the second end 412 is electrically connected to the electrical connectors 140. The wires 406 extend into the connectors 136, 140 far enough to electrically connect to the contacts 232, 242 (FIG. 2) and to allow for strain relief for the wires 406. Between the first and second ends 410, 412, the wire bundle 408 extends through the wire openings 402, 404 and across the module gap 302. The wire bundle 408 may extend across the module gap 302 at an axial location between the front ends 202, 206 and the rear ends 204, 208 of the modules 130, 132. For example, the wire bundle 408 optionally may not extend beyond the rear walls 212, 216 of the shells 134, 138.

The flexible shroud 304 within the module gap 302 is hollow and surrounds the wire bundle 408. The flexible shroud 304 protects the wires 406 from external forces, such as air flow and manual handling, and also prevents exposure to debris, dirt, moisture, contaminants, and the like. The flexible shroud 304 optionally surrounds or includes a conductive EMI material for EMI suppression and/or containment along the lengths of the wires 406 within the module gap 302. The accordion or bellows shape of the flexible shroud 304 is configured to allow the flexible shroud 304 to elongate and contract as the first and second modules 130, 132 are moved relative to each other parallel to the longitudinal axis 191.

In the illustrated embodiment, the housing 230 of the visible electrical connector 136 projects through a corresponding connector opening 414 in the front wall 210 of the shell 134. Likewise, the housing 240 of the visible electrical connector 140 projects through a corresponding connector opening 416 in the front wall 214 of the shell 138. Optionally, the connector openings 414, 416 may be sized to have clearance gaps between the housings 230, 240 and respective edges 418, 420 of the connector openings 414, 416 to allow the connectors 136, 140 to move vertically and/or laterally relative to the respective shell 134, 138. Although not shown in FIG. 4, the housings 230, 240 may be mounted to the shells 134, 138 via flanges, fasteners, adhesives, or the like, to restrict longitudinal movement of the connectors 136, 140 relative to the shells 134, 138. It is recognized, however, that the connectors 136 of the first module 130 can move longitudinally with the shell 134 relative to the second module 132 as the first module 130 is moved relative to the second module 132, and similarly for the connectors 140 of the second module 132.

Figure 5:
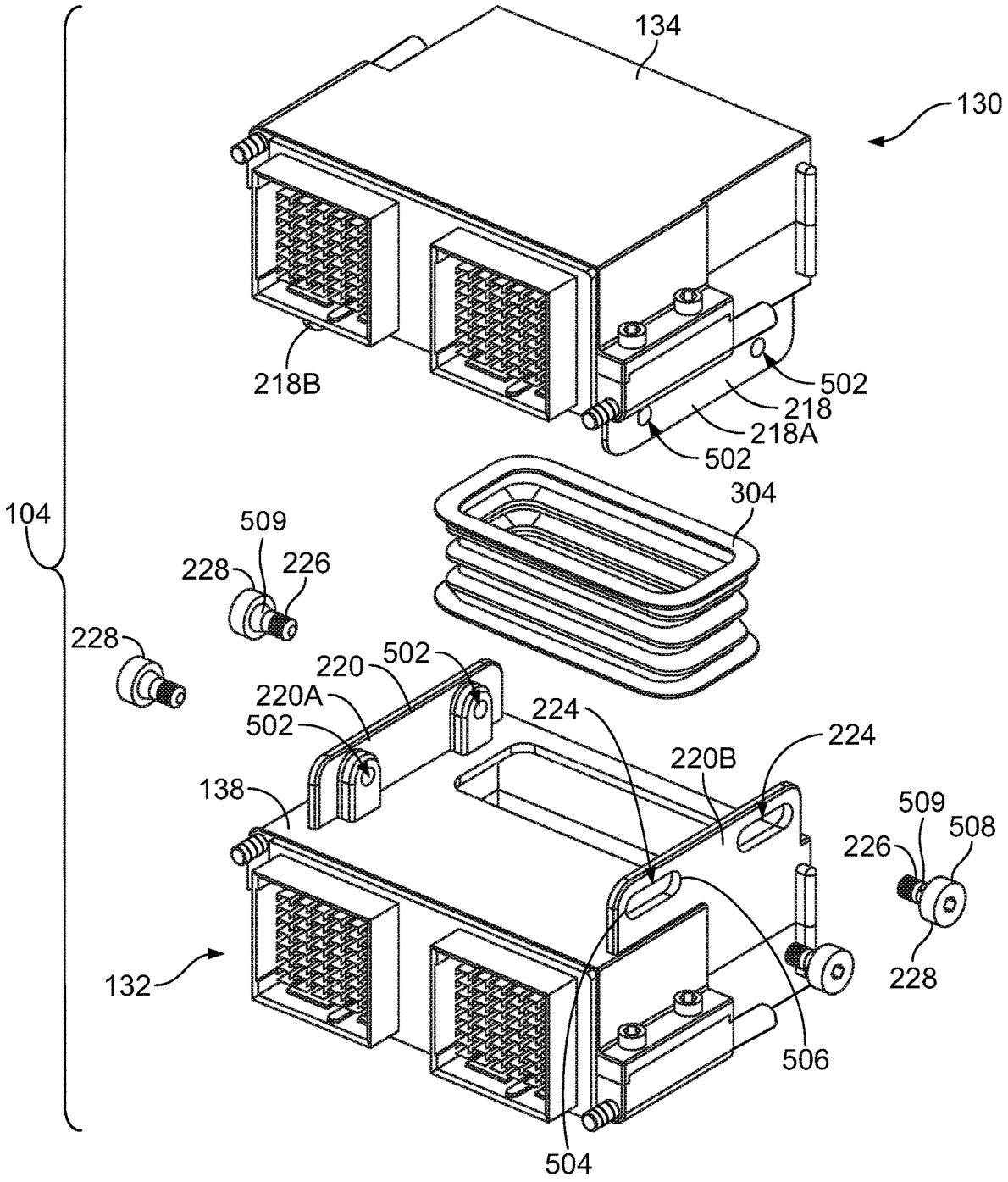
FIG. 5 is an exploded perspective view of the connector assembly according to an embodiment.

FIG. 5 is an exploded perspective view of the connector assembly 104 according to an embodiment. The exploded view shows the first module 130 spaced apart from the second module 132, and the flexible shroud 304 spaced apart from both modules 130, 132. The wire bundle 408 (shown in FIG. 4) is omitted in FIG. 5. In the illustrated embodiment, the coupling flanges 220 of the second module 132 are different from one another. For example, a first coupling flange 220A defines two apertures 502 that are each sized to receive the post or shaft 226 of a different one of the fasteners 228. The apertures 502 optionally include helical threads (not shown) for securing the first coupling flange 220A to the fasteners 228. A second coupling flange 220B of the coupling flanges 220 across from the first coupling flange 220A defines two of the elongated slots 224. The slots 224 have longer lengths in the longitudinal direction than the apertures 502. For example, the apertures 502 may be circular. Each of the slots 224 is configured to receive a corresponding post of shaft 226 of a different fastener 228 therein. Each slot 224 allows the corresponding shaft 226 to move (e.g., slide) longitudinally within the respective slot 224 between opposite first and second end edges 504, 506 of the slot 224. The lengths of the slots 224 between the first and second end edges 504, 506 may at least partially define the permitted range of movement of the first and second modules 130, 132 relative to each other. In one or more embodiments, the fasteners 228 may be screws or bolts having shafts 226 received within the slots 224 and apertures 502, and larger-diameter heads 508 that are not received within the slots 224 or the apertures 502. For example, the fasteners 228 in the illustrated embodiment are shoulder screws 228 that have a smooth shoulder 509 between the head 508 and the shaft 226. The shoulder 509 engages edges of the slot 224 and is configured to slide within the fixed length of the slot 224. The shaft 226 is threaded and is configured to be threadably coupled to the aperture 502.

The coupling flanges 218 of the first module 130 are also different from each other, such that a first coupling flange 218A defines two apertures 502, and a second coupling flange 218B defines two slots 224 (not visible in FIG. 5). When assembled, the first coupling flange 218A (e.g., with the apertures 502) of the first module 130 couples to the second coupling flange 220B (e.g., with the slots 224) of the second module 132. Each shaft 226 extends through one of the slots 224 and one of the apertures 502. The slots 224 allow the coupling flange 218A to slide longitudinally relative to the coupling flange 220B, while remaining mechanically coupled together. The second coupling flange 218B of the first module 130 may couple to the first coupling flange 220A of the second module 132 in the same way.

In the illustrated embodiment, the shell 134 of the first module 130 is a replica of the shell 138 of the second module 132. For example, the shell 134 has the same size, shape, features, and arrangement of features as the shell 138, such that the two shells 134, 138 are copies of each other. Although the shells 138 may be replica copies of each other, the shells 138 may have different orientations in the connector assembly 104. For example, the shell 134 of the first module 130 is rotated 180 degrees about the longitudinal axis 191 relative to the shell 138 of the second module 132. Therefore, the wire opening 402 of the shell 134 of the first module 130 faces the wire opening 404 of the shell 134 of the second module 132 across the module gap 302. Constructing the connector assembly 104 using replica shells 134, 138 may reduce manufacturing costs as only one type of shell needs to be molded and/or formed to achieve both shells 134, 138.

Figure 7:
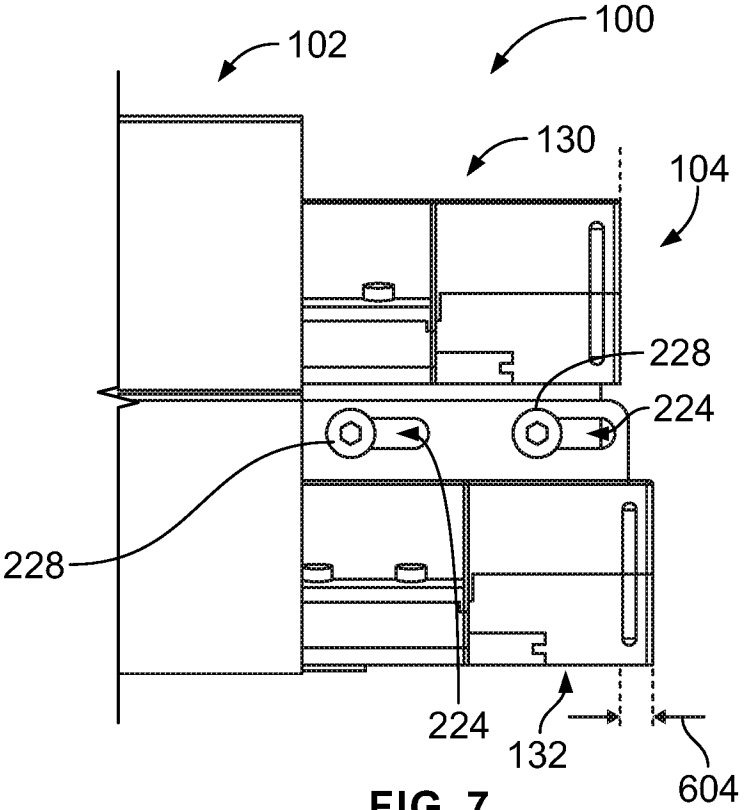
FIG. 7 is a side view of the electrical system in the first mating position shown in FIG. 6.
Figure 6:
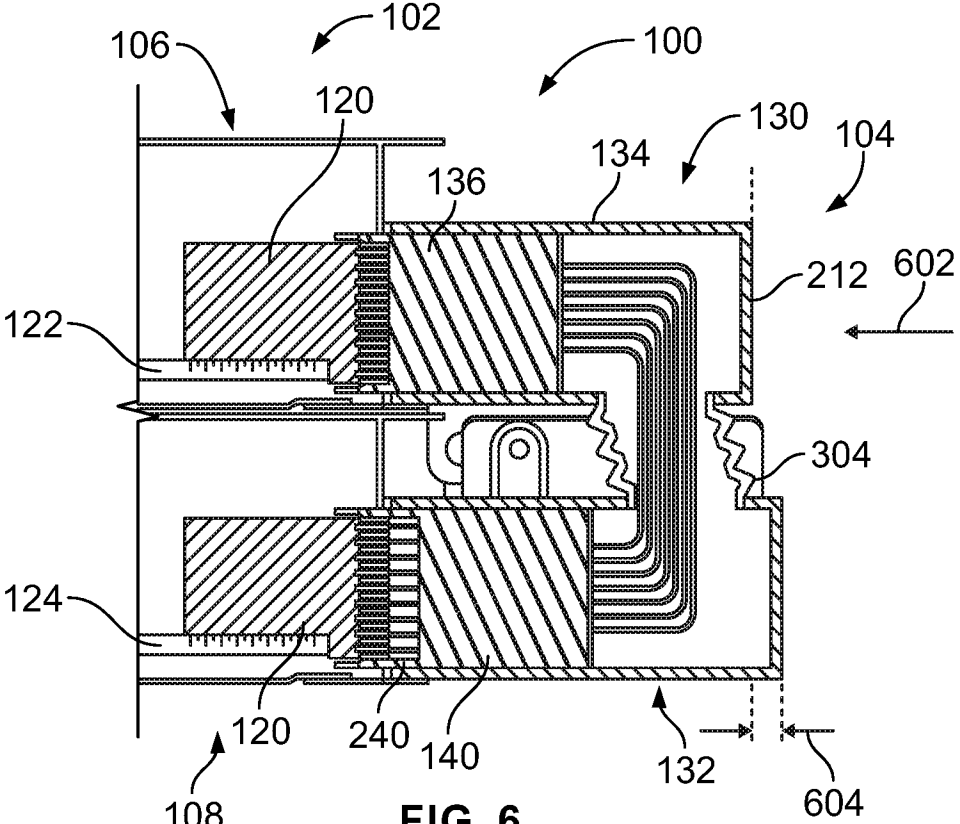
FIG. 6 is a cross-sectional view of the electrical system in a first mating position according to an embodiment.

FIG. 6 is a cross-sectional view of the electrical system 100 in a first mating position according to an embodiment. FIG. 7 is a side view of the electrical system 100 in the first mating position. In the first mating position, the first module 130 is mated to the first electrical device 106 of the device assembly 102, and the second module 132 is poised for mating (without being mated) to the second electrical device 108. Although the first and second modules 130, 132 are mechanically coupled together, the modules 130, 132 can be moved longitudinally relative to each other to allow for sequential mating to the corresponding electrical devices 106, 108, which reduces the magnitude of mating effort or force required and also may improve mating by reducing the risk of damage or mis-mating caused by misalignment. By sequential mating, the mating forces may be reduced by at least half, as opposed to mating both the first and second modules 130, 132 to the device assembly 102 at the same time.

Once the connector assembly 104 is poised for mating to the device assembly 102, the first mating position is achieved by moving the first module 130 in a mating direction 602 towards the first electrical device 106. For example, an operator may manually push the rear wall 212 of the shell 134 of the first module 130 in the mating direction 602, or may use a tool or automatic machine to push the first module 130. The mating direction 602 is parallel to the longitudinal axis 191 (FIG. 2), such that the first module 130 slides longitudinally relative to the second module 132. The electrical connectors 136 of the first module 130 mate to the mating electrical connectors 120 of the first electrical device 106. The second module 132 may be retained in a non-mating position while the first module 130 is moved in the mating direction 602. For example, the housings 240 of the electrical connectors 140 may abut against the mating connectors 120 of the second electrical device 108, or the like, to prevent the second module 132 from mating while the first module 130 is pushed in the mating direction 602.

In the first mating position, the first module 130 is offset by a longitudinal offset distance 604 relative to the second module 132. The flexible shroud 304 is angled relative to the vertical axis 192 (FIG. 2) to accommodate the longitudinal offset distance 604. As shown in FIG. 7, in the first mating position, the fasteners 228 are disposed at or proximate to the first end edges 504 (shown in FIG. 5) of the slots 224.

Figure 9:
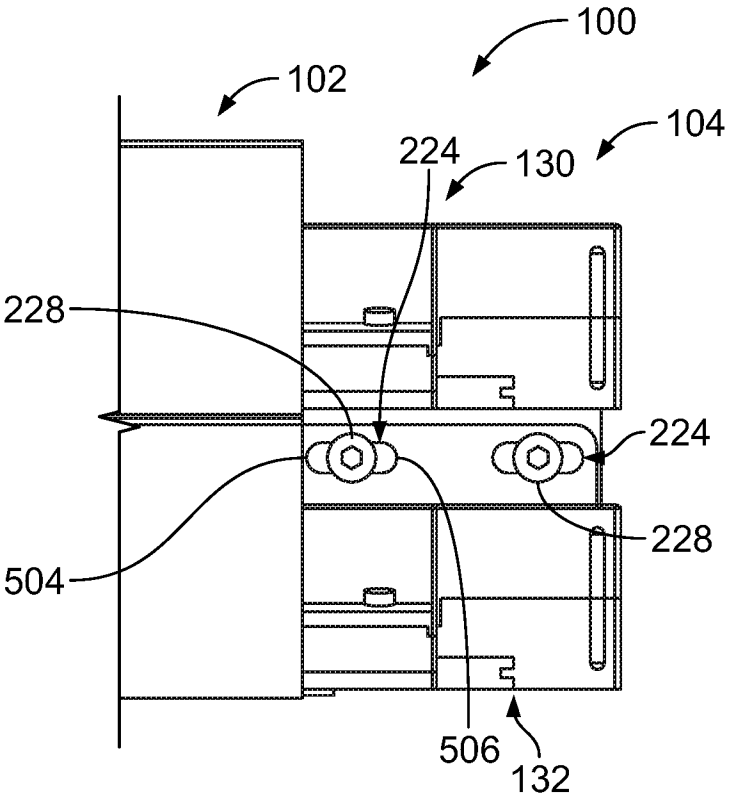
FIG. 9 is a side view of the electrical system in the second mating position shown in FIG. 8.
Figure 8:
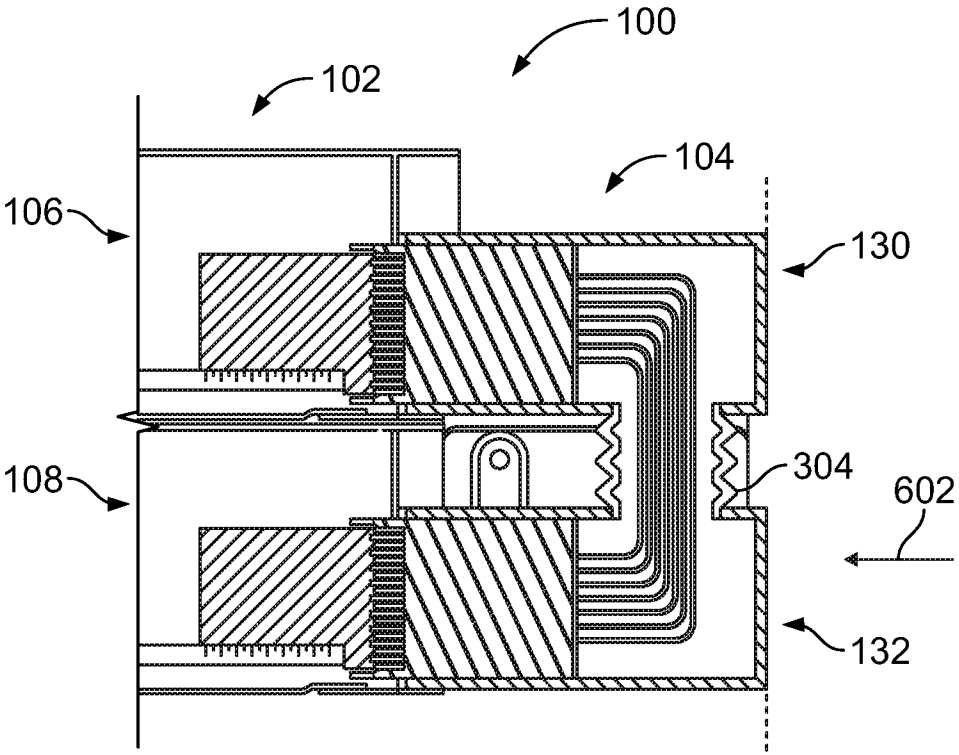
FIG. 8 is a cross-sectional view of the electrical system in a second mating position according to an embodiment.

FIG. 8 is a cross-sectional view of the electrical system 100 in a second mating position according to an embodiment. FIG. 9 is a side view of the electrical system 100 in the second mating position. In the second mating position, the first and second modules 130, 132 are mated to the first and second electrical devices 106, 108, respectively, of the device assembly 102. The second mating position may be achieved subsequent to the first mating position. For example, after the first module 130 is mated to the first electrical device 106, then the second mating position may be achieved by applying a force on the second module 132 in the mating direction 602 to mate the second module 132 to the second electrical device 108. Thus, the first and second modules 130, 132 may be mated sequentially. Since the first module 130 is already mated to the first electrical device 106, the force on the second module 132 causes the second module 132 to move (e.g., slide) longitudinally relative to the first module 130 to mate with the second electrical device 108. In the second mating position when both modules 130, 132 are mated, the modules 130, 132 may be generally aligned. The flexible shroud 304 extends parallel to the vertical axis 192 between the modules 130, 132. As shown in FIG. 9, the fasteners 228 are disposed at midpoints of the slots 224 between the first and second end edges 504, 506 when the modules 130, 132 are aligned. Although the first and second modules 130, 132 are aligned in the illustrated embodiment, it is recognized that the first and second modules 130, 132 may be offset when the first and second modules 130, 132 are mated to the corresponding electrical devices 106, 108, such as due to system tolerances or bowed components. When the first and second modules 130, 132 are offset, the fasteners 228 would be spaced apart from the midpoints of the slots 224 a distance and direction corresponding to the offset.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely example embodiments. Many other embodiments and modifications within the spirit and scope of the claims will be apparent to those of ordinary skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A connector assembly comprising:

a first module and a second module, each of the first and second modules extending parallel to a longitudinal axis between a respective front end and a respective rear end opposite the front end, each of the first and second modules including a respective shell and one or more electrical connectors held by the shell and exposed at the respective front end for mating to a corresponding mating electrical device, wherein the shell of the first module includes one or more coupling flanges, at least one of the one or more coupling flanges defining a slot therethrough that is configured to receive a corresponding post therein to mechanically couple the shell of the first module to the shell of the second module between the front and rear ends of the first module, the slot configured to allow the shell of the first module to slide relative to the corresponding post along a length of the slot as the first module moves parallel to the longitudinal axis, relative to the second module, to allow for separately mating the first and second modules to the corresponding mating electrical devices.

2. The connector assembly of claim 1, wherein an inner wall of the shell of the first module faces an inner wall of the shell of the second module, each of the shells defining an opening through the respective inner wall, wherein the one or more electrical connectors of the first module are electrically connected to the one or more electrical connectors of the second module via one or more wires that extend through the openings in the inner walls of the shells.

3. The connector assembly of claim 1, wherein an inner wall of the shell of the first module is separated from an inner wall of the shell of the second module via a module gap, wherein one or more wires extend across the module gap at an axial location between the front and rear ends of the first and second modules, wherein the connector assembly further includes a flexible shroud within the module gap that surrounds the one or more wires.

4. The connector assembly of claim 1, wherein the shell of the first module is a replica of the shell of the second module, the shell of the first module oriented 180 degrees about the longitudinal axis relative to the shell of the second module.

5. The connector assembly of claim 1, wherein the first module is stacked vertically above the second module along a vertical axis, and each of the first and second modules includes multiple electrical connectors of the one or more electrical connectors, the electrical connectors of each of the first and second modules being arranged side by side parallel to a lateral axis that is perpendicular to the vertical axis.

6. The connector assembly of claim 1, wherein each of the one or more electrical connectors of the first module includes a respective housing that is mounted within the shell of the first module, and each of the one or more electrical connectors of the second module includes a respective housing that is mounted within the shell of the second module.

7. The connector assembly of claim 6, wherein each of the housings of the one or more electrical connectors of the first module extends through a connector opening in a front wall of the shell of the first module at the front end thereof and projects beyond the front wall.

8. The connector assembly of claim 1, wherein each of the first and second modules includes one or more lock screws at the front end thereof, the lock screws mounted to the shells of the first and second modules and configured to releasably secure to the corresponding mating electrical devices.

9. A connector assembly comprising:

a first module including a shell and one or more electrical connectors held by the shell and exposed at a front end of the first module for mating to a first electrical device;

a second module including a shell and one or more electrical connectors held by the shell of the second module and exposed at a front end of the second module for mating to a second electrical device; and a wire bundle of multiple electrical wires, the wire bundle having a first end electrically connected to the one or more electrical connectors of the first module within the shell of the first module and a second end electrically connected to the one or more electrical connectors of the second module within the shell of the second module, wherein the first and second modules are stacked adjacent to each other and mechanically coupled to each other such that a module gap is defined between an inner wall of the shell of the first module and an inner wall of the shell of the second module, wherein the wire bundle extends through respective openings in the inner walls of the first and second modules and across the module gap.

10. The connector assembly of claim 9, further comprising a flexible shroud within the module gap and mounted to the inner walls of the first and second modules, the flexible shroud surrounding the wire bundle along the module gap.

11. The connector assembly of claim 9, wherein the inner walls of the shells of the first and second modules extend parallel to a longitudinal axis from front walls of the respective shells to rear walls of the respective shells, wherein the first module is movable relative to the second module parallel to the longitudinal axis to allow for separately mating the first and second modules to the corresponding first and second electrical devices.

12. The connector assembly of claim 9, wherein each of the shells of the first and second modules includes multiple coupling flanges extending from the respective inner wall into the module gap, wherein the coupling flanges of the first module are mechanically coupled to different corresponding coupling flanges of the second module via fasteners to mechanically couple the first and second modules together.

13. The connector assembly of claim 12, wherein at least some of the coupling flanges define one or more slots therethrough that receive the fasteners therein, wherein the slots are elongated parallel to the longitudinal axis and allow the coupling flanges of the shell of the first module to slide longitudinally relative to the coupling flanges of the shell of the second module along lengths of the slots.

14. The connector assembly of claim 9, wherein each of the one or more electrical connectors of the first module includes a respective housing that is mounted within the shell of the first module, and each of the one or more electrical connectors of the second module includes a respective housing that is mounted within the shell of the second module.

15. A connector assembly comprising:

an upper module including a shell having a front wall and a rear wall opposite the front wall, the upper module including multiple electrical connectors arranged side by side parallel to a lateral axis, each of the electrical connectors including a housing held by the shell and signal contacts within the housing that are exposed along the front wall of the shell; and a lower module including a shell having a front wall and a rear wall opposite the front wall, the lower module including multiple electrical connectors arranged side by side parallel to the lateral axis, each of the electrical connectors of the lower module including a housing held by the shell of the lower module and signal contacts within the housing that are exposed along the front wall of the shell of the lower module, wherein the upper module is stacked vertically above the lower module, wherein the shell of the upper module is mechanically coupled to the shell of the lower module and movable relative to the shell of the lower module parallel to a longitudinal axis that is perpendicular to the lateral axis to allow for separately mating the upper and lower modules to corresponding first and second electrical devices.

16. The connector assembly of claim 15, wherein an inner wall of the shell of the upper module is spaced apart from an inner wall of the shell of the lower module to define a module gap, each of the shells defining an opening through the respective inner wall, wherein the electrical connectors of the upper module are electrically connected to the electrical connectors of the lower module via wires that extend through the openings of the inner walls and across the module gap.

17. The connector assembly of claim 16, further comprising a flexible shroud within the module gap and mounted to the inner walls of the shells of the upper and lower modules, the flexible shroud surrounding the wires along the module gap.

18. The connector assembly of claim 15, wherein the shell of the upper module is a replica of the shell of the lower module and is oriented 180 degrees about the longitudinal axis relative to the shell of the lower module.

19. The connector assembly of claim 15, wherein wires extend between the upper and lower modules and electrically connect the electrical connectors of the upper module to the electrical connectors of the lower module.

20. The connector assembly of claim 15, wherein the signal contacts within the housing of each respective electrical connector in the upper module are arranged in an array of multiple rows and columns.

* * * * *